US007293333B2

(12) United States Patent
Stenhäll

(10) Patent No.: US 7,293,333 B2
(45) Date of Patent: Nov. 13, 2007

(54) WATER REPELLENT SLIDE FASTENER

(76) Inventor: Turo Stenhäll, Flat D, 8/F, Tower 11, Tierra Verde, Tsing Yi, N.T. (HK)

( * ) Notice: Subject to any disclaimer, the term of this patent is extended or adjusted under 35 U.S.C. 154(b) by 157 days.

(21) Appl. No.: 10/531,856

(22) PCT Filed: Oct. 10, 2003

(86) PCT No.: PCT/FI03/00754

§ 371 (c)(1),
(2), (4) Date: Apr. 18, 2005

(87) PCT Pub. No.: WO2004/039199

PCT Pub. Date: May 13, 2004

(65) Prior Publication Data

US 2006/0010660 A1 Jan. 19, 2006

(30) Foreign Application Priority Data

Oct. 29, 2002 (FI) ..... 20021919

(51) Int. Cl.
*A44B 19/32* (2006.01)

(52) U.S. Cl. ..... 24/389; 24/432

(58) Field of Classification Search ..... 24/384, 24/389, 397, 398, 415, 426–428, 432
See application file for complete search history.

(56) References Cited

U.S. PATENT DOCUMENTS 2,077,350 A * 4/1937 Sundback ..... 24/401
2,325,332 A * 7/1943 Marinsky ..... 24/384
2,370,059 A 2/1945 Marinsky
3,129,479 A * 4/1964 Morin ..... 24/428
4,455,722 A * 6/1984 Oda ..... 24/427
5,008,986 A 4/1991 Laudet et al.
5,444,898 A * 8/1995 Norvell ..... 24/389
5,628,094 A 5/1997 Mizuno
2004/0045140 A1 * 3/2004 Kawahara ..... 24/399

FOREIGN PATENT DOCUMENTS

EP 1 057 423 12/2000
EP 1 175 842 1/2002
EP 1 201 144 5/2002

* cited by examiner

*Primary Examiner*—James R Brittain
(74) *Attorney, Agent, or Firm*—Renner, Kenner, Grieve, Bobak, Taylor & Weber

(57) ABSTRACT

A water repellent slide fastener includes a pair of zipper tapes (25, 26), to which are secured fastening elements (21, 22) which are unfastenable and fastenable through the intermediary of a zipper slide (30), said zipper tapes (25, 26) being water repellent. One zipper tape (25) extends, in the form of an extension (25X), over the other zipper tape (26) to overlap a part of the other zipper tape (26).

7 Claims, 1 Drawing Sheet

WATER REPELLENT SLIDE FASTENER

The invention relates to a slide fastener which is water repellent.

The invention relates also to a zipper for use in association with a slide fastener which is water repellent.

The prior art discloses both waterproof and water-repellent slide fasteners. The manufacture of waterproof slide fasteners or zippers is expensive, and the resulting designs will be highly inflexible and heavy, as well as inconvenient to use. Water repellent slide fasteners are simpler and generally more nimble-acting, i.e. more convenient to use, than watertight slide fasteners, yet suffer from a problem of letting water through themselves or at least seeping water to some extent through themselves.

U.S. Pat. No. 5,386,616 (W.L. Gore & Associates, Inc.) describes a water repellent slide fastener and a method for the manufacture of a water repellent zipper seam. In the solution disclosed in the cited publication, the inner and outer faces of a slide fastener's zipper tapes are provided with a water repellent coating, capable of eliminating the penetration of water therethrough. When the slide fastener is secured to a garment or the like, a sealing tape, provided with a gripping surface, is set to cover a stitching or the like, by which the zipper tape is further secured for enhancing the blocking of water penetration. This prior known solution is intended to be implemented by using such a conventional zipper, in which the zipper's fastening elements are tightly adjoined to each other. This type of design, in which a zipper's fastening elements would be in contact with each other in a sealing manner, is not known in practice as the conventional slide fastener always leaks or seeps water therethrough between the fastening elements.

U.S. Pat. No. 6,105,214 describes a water repellent slide fastener, comprising a pair of zipper tapes, each having a first and a second surface on opposite sides and each carrying a string of fastening elements disposed along the edges of said first surface, and a water repellent layer on said opposite surface, wherein the water repellent layer has an adhesion to the zipper tapes of at least 6 lb/in. This prior known solution is implemented by using a water repellent layer, having a width equal to that of the slide fastener, which layer is split down the centre line for enabling the use of the slide fastener. Straight cutting surfaces are used in an effort to provide an excellent water barrier. One problem in this prior known solution is that the split itself may develop a gap, providing a way for water drops through the slide fastener and inside a garment.

The prior art discloses also other solutions for water repellent slide fasteners, which use e.g. a water repellent tape or the like in connection with zipper tapes and for which reference can be made, for example, to U.S. Pat. No. 3,668,745, UK patent 1,318,360, and DE laid-open application 34 45 023. In these prior known solutions, the zipper tapes are provided with a water repellent layer or made of a water repellent material, the water repellent strip being disposed in such a way that a gap is possibly left in line with the slide fastener, whereby water and moisture may find a way inside a garment.

A problem with various waterproof and water-repellent designs in solutions known from the prior art has been their inflexibility, poor sliding properties of the zipper slide, their high price and complexity. Consequently, these prior art solutions have generally been tight or thick, in which regard reference can also be made to DE publication 22 62 836, CH Patent publication 182,027, and U.S. Pat. No. 4,724,586, as well as to EP laid-open publication 0,303,318.

New problems regarding the water tightness and water repellance of slide fasteners are created by aging and wearing of the slide fastener. Many of the prior known water-repellent solutions are based on a smooth edge surface at the interface of a slide fastener, said surfaces being driven against each other with various methods and forces, but, as a result of wearing, yarn ends, debris, dirt and mud, etc., the interface of the edge surfaces may begin to let water through.

Furthermore, the water tightness and water repellance of a slide fastener according to prior known solutions deteriorate generally to quite a poor level as a result of the slide fastener being exposed to lateral tensile forces, and the gap between zipper tapes opens up in most cases to the width of as much as 1-2 mm.

It is an object of the invention to provide a water repellent slide fastener, which enables an easy-to-use, easy-sliding zipper, yet provides a reliable shield for water leakage and seepage.

Another object of the invention is to provide a type of water repellent slide fastener, which is not left with such a gap that lets moisture inside a garment.

A further object of the invention is to provide a water repellent slide fastener, which is simple and convenient in terms of manufacture and attachment to a garment.

One object of the invention is also to provide a type of slide fastener, which maintains water repellance despite becoming worn, soiled, dirty, etc.

In order to accomplish the foregoing and subsequently presented objectives, a slide fastener of the invention is principally characterized by first and second zipper tapes which are secured to fastening elements asymmetrically relative to each other, such that the first zipper tape extends, in the form of an extension crossing a centre line between tooth elements, over the second zipper tape to overlap a part of the second zipper tape, which has its other edge, the far edge relative to the garment, fitted with fastening elements, and the zipper tape, which has the extension, has the fastening elements secured to the point, from which the extension commences.

On the other hand, a zipper slide for use in conjunction with a slide fastener of the invention is principally characterized in that the zipper slide has one of its body members formed with a recess for the extension of the zipper tape.

In a slide fastener of the invention, the zipper tapes, made water repellent in a manner known as such from the prior art, e.g. by laminating a waterproof film on the zipper tape (U.S. Pat. No. 6,105,214, GB 131,360) or e.g. by coating the tapes (EP 0,303,218), or manufactured from a water repellent material, are arranged in such a way that one zipper tape extends over the other tape to cover or overlap the slide fastener's fastening element members and a part of the other zipper tape. As one zipper tape is so arranged as a shield on top of the edge of the fastening elements' other zipper tape, water drops or the like flow away over the slide fastener's split without making it through the slide fastener and inside a garment. In addition, the invention provides a possibility of utilizing gravity for improving water repellance. The inventive slide fastener is most preferably positioned in an article, e.g. a garment, a shoe, a bag, or the like, such that water drops are able to flow under gravity across the lip without being allowed into the slide fastener's centre split in response to gravity.

The zipper slide, used in conjunction with a slide fastener of the invention, has the one of its body members, which is located on the same side as an extension element, formed with a space, e.g. a recess, capable of accommodating the extension element.

According to a preferred further feature of the invention, the inflexibility of a zipper tape is utilized for pressing the lip of one tape firmly against the other tape, such that the water-repellent zipper tape's extension has at least such inflexibility that the extension bears against the underlying zipper tape with at least a small weight and, at the same time, the dimensioning of a slide can be utilized by dimensioning said space in such a way that it presses the lip firmly against the second tape.

The invention will now be described in more detail with reference to figures shown in the accompanying drawing, the intention being by no means to narrowly limit the invention to details illustrated therein.

Figure 1:
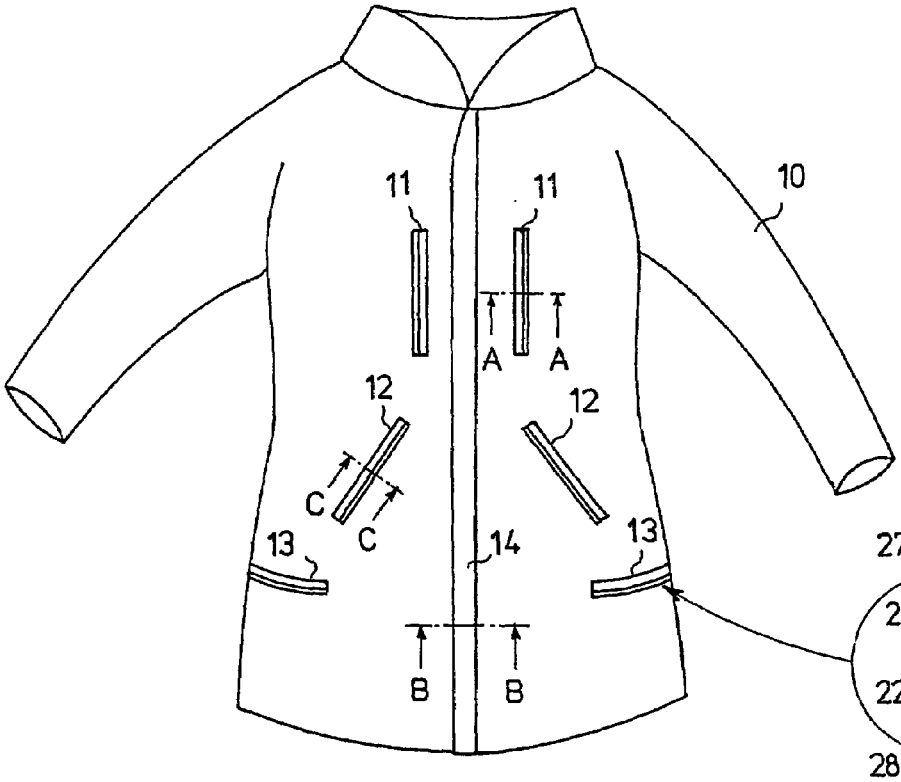
FIG. 1 shows schematically a garment, for example an outdoor coat, provided with a few embodiments for a water repellent slide fastener of the invention.

A garment 10, e.g. an outdoor coat, illustrated in FIG. 1, is provided with slide fasteners or zippers 11, 12, 13 and 14, the slide fasteners 11, 12 and 13 being pocket zippers, and the slide fastener 14 being a zipper for the garment's front portion or, in this case, a coat-closing zipper. Each slide fastener 11, 12, 13, 14 is water repellent in accordance with the invention. The sections A-A, B-B, C-C and D-D indicated in FIG. 1 are visualized in FIGS. 2A, 2B, 2C, 2D, respectively. Slide fasteners of the invention can naturally be used in many applications, e.g. as zippers for various garments, shoes, backpacks, etc., when a water repellent slide fastener is called for.

Figure 2D:
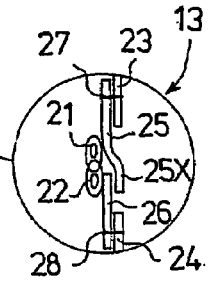
FIGS. 2A-2D show schematic sectional views of a few embodiments for a water repellent slide fastener of the invention, along sections A-A, B-B, C-C and D-D in FIG. 1.
Figure 2A:
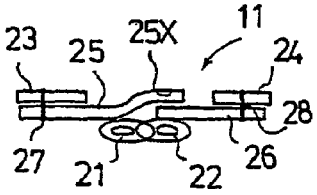
Figure 2B:
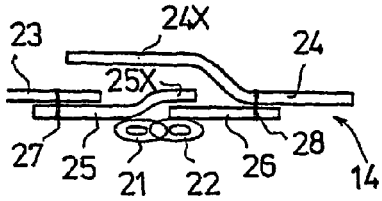
Figure 2C:
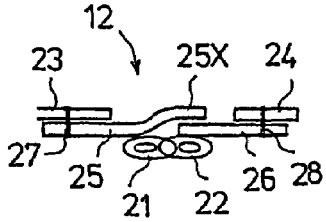

It is apparent from slide fasteners of the invention, shown in schematic cross-sectional views depicted in FIGS. 2A-2D, in which corresponding elements are indicated by the same reference numerals, that the inventive water repellent slide fastener 11, 12, 13, 14 is of such a design that the slide fastener's zipper tapes 25, 26 are made water repellent in a manner known as such from the prior art, and one zipper tape 25 extends over the other zipper tape 26 in the form of an extension 25X. Thus, water drops are denied access between the zipper tapes 25, 26 through the side fastener's fastening elements 21, 22 inside the garment 10. The zipper tapes 25, 26 are attached at one edge by way of stitches 27, 28 to the garment's 10 respective fabric sections 23, 24 and the zipper tapes 25, 26 have the fastening elements 21, 22 secured thereto. The other zipper tape 26 has its other edge, the far edge relative to the garment, fitted with the fastening elements 22, and the zipper tape 25, which has the extension 25X, has the fastening elements 21 secured to the point, from which the extension 25X commences, such that the fastening elements 21 will be covered by the extension 25X, i.e. remain inside a garment or the like. Hence, the zipper tapes 25 and 26 are secured to the fastening elements 21, 22 asymmetrically relative to each other, such that the zipper tape's 25 extension 25X crosses over a centre line between the fastening elements 21, 22 and extends onto the zipper tape 26 to conceal a part of the zipper tape 26, which does not cross the centre line between the fastening elements 21, 22. In the cross-sectional view of FIG. 2B, depicting the slide fastener 14 for the garment's 10 front split, the garment's fabric section 24, to which the zipper tape 26 is attached by way of the stitching 28, extends as an extension 24X, e.g. in the form of a lip, over the entire slide fastener assembly.

The zipper tapes 25, 26 are made watertight and/or water repellent in a manner known as such from the prior art, e.g. by laminating or coating. In addition, the stitches 27, 28 are made watertight and/or water repellent in a manner also known as such from the prior art by welding or by an adhesive tape.

Figure 3:
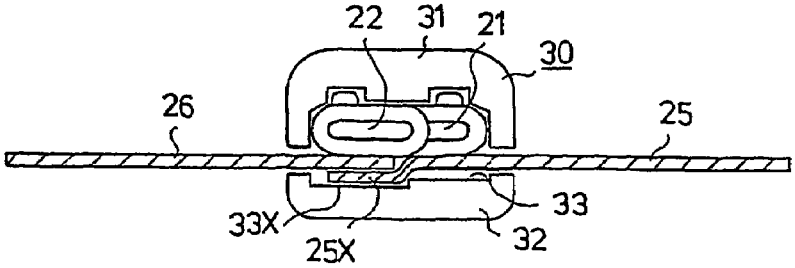
FIG. 3 shows schematically a sectional view of one embodiment for a zipper slide for use in connection with a slide fastener of the invention.

FIG. 3 shows schematically a cross-sectional view of a slide body for a zipper slide 30 for use in connection with a slide fastener of the invention, which consists of two body members 31, 32, the body member 32, set to be placed on the side of the zipper tapes 25, 26 opposite with respect to the slide fastener's tooth strings 21, 22, being formed with a recess 33X for the zipper tape's 25 extension 25X. By using the inflexibility of the zipper tapes 25, 26 and the dimensioning of the recess portion 33X of the zipper slide's 30 body member 32, it is possible to regulate the pressing of the extension element 25X against the zipper tape 26. The tape assembly for a slide fastener of the invention has an inflexibility or stiffness which is preferably 10 g-50 g. The slide's recess has a width which is preferably 1 mm-5 mm, and its depth is most conveniently equal to the tape thickness, i.e. within the range of 0.2-0.8 mm.

The invention has been described above, with reference to just some of its preferred embodiments, the intention being by no means to narrowly limit the invention to the details thereof.

The invention claimed is:

1. A water repellent slide fastener, comprising a pair of zipper tapes, to which are secured fastening elements which are unfastenable and fastenable through the intermediary of a zipper slide, said zipper tapes being water repellent, characterized in that the first and second zipper tapes are secured to the fastening elements asymmetrically relative to each other, such that the first one extends, in the form of an extension crossing a centre line between the fastening elements, over the second zipper tape to overlap a part of the second zipper tape, which has its other edge, the far edge relative to the garment, fitted with the fastening elements, and the zipper tape, which has the extension, has the fastening elements secured to the point, from which the extension commences.

2. A slide fastener as set forth in claim 1, characterized in that the extension of one zipper tape overlaps the other zipper tape over the distance of 1-5 mm, commencing from the edge of the zipper tape closer to the fastening elements.

3. A slide fastener as set forth in claim 1, characterized in that said extension substantially conceals the slide fastener's fastening elements.

4. A slide fastener as set forth in claim 1, characterized in that the zipper tape has its stiffness adapted to be such that the extension of one zipper tape applies at least a small weight against the other zipper tape.

5. A slide fastener as set forth in claim 1, characterized in that a slide fastener is fitted to an article, in such a way that the zipper tape has its extension positioned such that gravity denies the migration of water into possible gaps between the slide fastener's fastening elements and/or into the slide fastener's centre slot.

6. A slide fastener as set forth in claim 1, characterized in that the zipper slide has one of its body members formed with a recess for the extension of the zipper tape.

7. A slide fastener as set forth in claim 6, characterized in that the recess of the zipper slide has a width of 1-5 mm and a depth of 0,2-0,8 mm, whereby the extension element of one zipper tape presses against the other zipper tape.

* * * * *